US005707951A

United States Patent [19]

Masschelein et al.

[11] Patent Number: 5,707,951

[45] Date of Patent: Jan. 13, 1998

[54] LAUNDRY COMPOSITION CONTAINING DYE FIXATIVES AND CELLULASE

[75] Inventors: Axel Masschelein, Brussels; Bruno Albert Jean Hubesch, Tervuren, both of Belgium; Ellen Schmidt Baker, Cincinnati, Ohio

[73] Assignee: The Procter & Gamble Company, Cincinnati, Ohio

[21] Appl. No.: 828,004

[22] Filed: Mar. 27, 1997

Related U.S. Application Data

[63] Continuation of Ser. No. 398,469, Mar. 3, 1995, abandoned.

[51] Int. Cl.[6] ..... C11D 3/386; C11D 1/40; C11D 1/52

[52] U.S. Cl. ..... 510/320; 510/322; 510/330; 510/392

[58] Field of Search ..... 510/320, 322, 510/330, 392

[56] References Cited

U.S. PATENT DOCUMENTS

| | | | |
|---|---|---|---|
| 4,435,307 | 3/1984 | Barbesgaard et al. | 252/174.12 |
| 4,661,289 | 4/1987 | Parslen et al. | 252/547 |

FOREIGN PATENT DOCUMENTS

| | | | |
|---|---|---|---|
| 350 098 A1 | 1/1990 | European Pat. Off. | C12Q 1/34 |
| 462806 A2 | 12/1991 | European Pat. Off. | C11D 3/40 |
| 495 257 A1 | 7/1992 | European Pat. Off. | C11D 3/386 |
| 495 258 A1 | 7/1992 | European Pat. Off. | C11D 3/386 |
| 1396970 | 6/1975 | United Kingdom | G03C 1/04 |
| 2075028 | 11/1981 | United Kingdom | C12N 9/42 |
| 2095275 | 9/1982 | United Kingdom | C11D 3/386 |
| 91/13136 | 9/1991 | WIPO . | |
| 9117243 | 11/1991 | WIPO . | |

*Primary Examiner*—Glenn Caldarola
*Assistant Examiner*—Alexander G. Ghyka
*Attorney, Agent, or Firm*—Robert B. Aylor

[57] ABSTRACT

Laundry compositions, specifically fabric-conditioning compositions, to be used in the rinse cycle of laundry washing processes, are disclosed in order to improve color depth maintenance of colored fabrics upon single or multiple washing cycles. To achieve this, specific levels of cellulase and dye-fixing agents of the cationic type as well are used in the laundry compositions.

8 Claims, No Drawings

LAUNDRY COMPOSITION CONTAINING DYE FIXATIVES AND CELLULASE

CROSS-REFERENCE TO RELATED APPLICATION

This application is a file wrapper continuation of our application Ser. No. 08/398,469, filed Mar. 3, 1995, now abandoned.

FIELD OF THE INVENTION

The present invention relates to laundry compositions, specifically fabric-conditioning compositions, to be used in the rinse cycle of laundry washing processes in order to improve color depth maintenance of colored fabrics upon single or multiple washing cycles.

BACKGROUND OF THE INVENTION

With fashion moving towards more colored fabrics, especially multi-colors, the problem of dye transfer during wet treatments has become more acute. When mixed colored fabrics and mixed loads of colored and white fabrics are washed in a laundering process, there is a risk of dye transfer through the treatment liquor from one fabric to another.

Dye transfer can result from color bleeding and provokes fading of colors, discoloration and/or staining of fabrics which is of course undesirable and unacceptable. Fading of colored fabrics upon repeated washing cycles is an identified concern for the laundry consumer. Fading can occur via dye loss in the washing liquor due to poor binding between the dyestuff and the fabric fiber, but can also occur via the formation of pills at the surface of the fabric.

Formulators of fabric cleaning products, e.g. detergents with a cleaning function and formulators of rinse-added fabric softeners providing both softening and anti-static benefits to fabrics, have clearly recognized the need to improve the color fidelity of dyed fabrics.

A wide variety of ingredients for use in laundry operations to improve the appearance of fabrics have been suggested in the past. For instance cellulase enzymes have been employed to enhance the appearance of (colored) cotton fabrics. Another means for addressing the problem of color loss employs dye transfer inhibiting agents in the wash liquor.

Although the use of cellulases and dye transfer inhibiting agents can meet the consumer needs to a certain extent for maintaining color fidelity, there is certainly a need for improvements in this area.

In EP 462 806 is disclosed a process and composition for treating fabrics to reduce the amount of dye released from colored fabrics during wet treatments such as washing and rinsing processes. In order to achieve this, cationic dye fixing agents are added to the laundry composition whereby the temperature of the wash solution is below 40° C. throughout the process. Optionally enzymes such as cellulases, proteases and amylases are added to the detergent composition.

Nowhere is disclosed that specific levels of cellulase, more specifically cellulases as described in International Patent Application WO 91/17243, ranging from 0.05 CEVU/g to 125 CEVU/g of finished product in combination with cationic dye fixatives leads to an improved color depth maintenance of colored fabrics upon single or multiple washing cycles.

SUMMARY OF THE INVENTION

The present invention relates to laundry compositions, detergents as well as rinse added fabric softeners comprising a cellulase enzyme and a cationic dye fixing agent wherein the enzyme is present at a level ranging from 0.05 CEVU/gram to 125 CEVU/gram of finished product and wherein the dye fixing agent is present at levels comprised between 0.01% and 50% by weight.

Most preferred cellulases are those described in International Patent Application WO 91/17243. A cellulase preparation useful in the compositions of the invention can consist essentially of a homogeneous endoglucanase component, which is immunoreactive with an antibody raised against a highly purified 43 kD cellulase derived from Humicola insolens DSM 1800, or which is homologous to said 43 kD endoglucanase. Preferred dye fixative agents include members selected from the group consisting of cationic dye fixatives, e.g. Sandofix TPS®, Sandofix WE56®, Indosol CR®, Solidogen FRZ® and the like, from Sandoz.

DETAILED DESCRIPTION OF THE INVENTION

The present invention is concerned with improved color depth maintenance of colored fabrics upon single or multiple washing cycles.

The improvement in color fidelity obtained by the present invention can be measured in several ways.

One way is that panels of expert graders visually compare, according to the established panel score unit (PSU) scales, fabrics treated with and without the composition according to the present invention.

Another way is the determination of so-called delta-E values. Delta E's are defined, for instance, in ASTM D2244. Delta E is the computed color difference as defined in ASTM D2244, i.e. the magnitude and direction of the difference between two psychophysical color stimuli defined by tristimulus values, or by chromaticity coordinates and luminance factor, as computed by means of a specified set of color-difference equations defined in the CIE 1976 CIELAB opponent-color space, the Hunter opponent-color space, the Friele-MacAdam-Chickering color space or any equivalent color space.

Alternatively, color depth can be characterized by the ratio k/s where k is an extinction coefficient of the dye proportional to its concentration in the fabric, whereas s is a scattering coefficient which signifies the reflectivity of light of the fabric support.

k decreases when dyestuff is displaced from bleeding garments and s increases when the fabric is more pilled. Both effects result in a lower k/s ratio and consequently lead to a loss of color depth.

The purpose of the present invention is to address both mechanisms of color depth loss at once, i.e. to affect both k and s as well with a unique combination of technologies acting cooperatively towards better maintenance of k/s upon repeated washing cycles.

Cellulase enzymes

An essential component of the laundry composition according to the invention is a cellulase enzyme.

The cellulases usable in the present invention include both bacterial or fungal cellulase. Preferably, they will have a pH optimum of between 5 and 9.5. Suitable cellulases are disclosed in U.S. Pat. No. 4,435,307, Barbesgoard et al, which discloses fungal cellulase produced from Humicola insolens. Suitable cellulases are also disclosed in GB-A-2,075,028; GB-A-2,095,275 and DE-OS-2,247,832.

Examples of such cellulases are cellulases produced by a strain of Humicola insolens (Humicola grisea var.

thermoidea), particularly the Humicola strain DSM 1800. Other suitable cellulases are for instance cellulases originated from Humicola insolens having a molecular weight of about 50 KDa, an isoelectric point of 5.5 and containing 415 amino acids. Especially suitable cellulases are the cellulases having color care benefits. Examples of such cellulases are cellulases described in European Patent application No. 91202879.2, filed Nov. 6, 1991 (Novo Nordisk A/S).

The cellulase added to the composition of the invention may be in the form of a non-dusting granulate, e.g. "marumes" or "prills", or in the form of a liquid, e.g., one in which the cellulase is provided as a cellulase concentrate suspended in e.g. a nonionic surfactant or dissolved in an essentially aqueous medium.

Preferred cellulases for use herein are characterized in that they provide at least 10% removal of immobilized radioactive labelled carboxymethyl-cellulose according to the $C^{14}$CMC-method described in EPA 350 098 (incorporated herein by reference in its entirety) at $25\times10^{-6}$% by weight of cellulase protein in the laundry test solution.

Most preferred cellulases are those as described in International Patent Application WO91/17243. For example, a cellulase preparation useful in the compositions of the invention can consist essentially of a homogeneous endoglucanase component, which is immunoreactive with an antibody raised against a highly purified 43 kD cellulase derived from *Humicola insolens,* DSM 1800, or which is homologous to said 43 kD endoglucanase.

The cellulases herein should be used in the compositions of the present invention at a level equivalent to an activity from about 0.05 to about 125 CEVU/gram of composition [CEVU=Cellulase (equivalent) Viscosity Unit, as described, for example, in WO 91/13136}, and most preferably about 5 to about 100 CEVU/gram. Such levels of cellulase are selected to provide the herein preferred cellulase activity at a level such that the compositions deliver an appearance-enhancing and/or fabric softening amount of cellulase below about 50 CEVU's per liter of rinse solution, preferably below about 30 CEVU's per liter, more preferably below about 25 CEVU's per liter, and most preferably below about 20 CEVU's per liter, during the rinse cycle of a machine washing process. Preferably, the present invention compositions are used in the rinse cycle at a level to provide from about 0.05 CEVU's per liter rinse solution to about 50 CEVU's per liter rinse solution, more preferably from about 0.1 CEVU's per liter to about 20 CEVU's per liter, even more preferably from about 0.1 CEVU's per liter to about 5 CEVU's per liter, and most preferably from about 0.1 CEVU's per liter to about 1.5 CEVU's per liter.

The cellulase consisting essentially of a homogeneous endoglucanase component which is immunoreactive with an antibody raised against a highly purified 43 kD cellulase derived from Humicola insolens, DSM 1800, or which is homologous to said 43 kD endoglucanase and BAN® cellulases, such as those available from NOVO NORDISK A/S, are especially useful herein. If used, such enzyme preparations will typically comprise from about 0.001% to about 2%, by weight, of the present compositions.

Fabric Softeners/Anti-stats

The compositions and processes herein may optionally also contain one or more fabric softening or anti-static agents to provide additional fabric care benefits. If used, such ingredients will typically comprise from about 0.5% to about 35%, by weight, of the present compositions, but may comprise up to about 90% by weight of the compositions, or higher, in high concentrate or solid forms. The preferred fabric softening agents to be used in the present invention compositions are quaternary ammonium compounds or amine precursors herein having the formula (I) or (II), below.

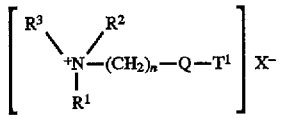

(I)

or

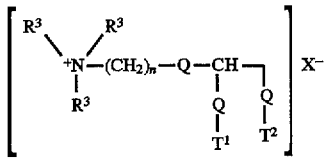

(II)

Q is —O—C (O)— or —C (O)—O— or —O—C(O)—O— or —$NR^4$—C(O)— or —C(O)—$NR^4$—; or mixtures thereof, e.g., an amide substituent and an ester substituent in the same molecule;

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1, T^2, T^3, T^4, T^5$ are (the same or different) $C_{11}$–$C_{22}$ alkyl or alkenyl;

n and m are integers from 1 to 4; and $X^-$ is a softener-compatible anion.

The alkyl, or alkenyl , chain $T^1$, $T^2$, $T^3$, $T^4$, $T^5$ must contain at least 11 carbon atoms, preferably at least 16 carbon atoms. The chain may be straight or branched.

Tallow is a convenient and inexpensive source of long chain alkyl and alkenyl material. The compounds wherein $T^1$, $T^2$, $T^3$, $T^4$, $T^5$ represents the mixture of long chain materials typical for tallow are particularly preferred.

Specific examples of quaternary ammonium compounds suitable for use in the aqueous fabric softening compositions herein include:

1) N,N-di(tallowyl-oxy-ethyl)-N,N-dimethyl ammonium chloride;
2) N,N-di(tallowyl-oxy-ethyl)-N-methyl, N-(2-hydroxyethyl) ammonium chloride or its corresponding amide (available as VARISOFT 222);
3) N,N-di(2-tallowyloxy-2-oxo-ethyl)-N,N-dimethyl ammonium chloride;
4) N,N-di(2-tallowyloxyethylcarbonyloxyethyl)-N,N-dimethyl ammonium chloride;
5) N-(2-tallowoyloxy-2-ethyl)-N-(2-tallowyloxy-2-oxo-ethyl)-N,N-dimethyl ammonium chloride;
6) N,N,N-tri(tallowyl-oxy-ethyl)-N-methyl ammonium chloride;
7) N-(2-tallowyloxy-2-oxoethyl)-N-(tallowyl-N,N-dimethyl-ammonium chloride; and
8) 1,2-ditallowyl oxy-3-trimethylammoniopropane chloride; and mixtures of any of the above materials.

Of these, compounds 1–7 are examples of compounds of Formula (I); compound 8 is a compound of Formula (II).

Particularly preferred is N,N-di(tallowoyl-oxy-ethyl)-N,N-dimethyl ammonium chloride, where the tallow chains are at least partially unsaturated.

The level of unsaturation of the tallow chain can be measured by the Iodine Value (IV) of the corresponding fatty acid, which in the present case should preferably be in the range of from 5 to 100 with two categories of compounds being distinguished, having a IV below or above 25.

Indeed, for compounds of Formula (I) made from tallow fatty acids having a IV of from 5 to 25, preferably 15 to 20, it has been found that a cis/trans isomer weight ratio greater than about 30/70, preferably greater than about 50/50 and more preferably greater than about 70/30 provides optimal concentratability.

For compounds of Formula (I) made from tallow fatty acids having a IV of above 25, the ratio of cis to trans isomers has been found to be less critical unless very high concentrations are needed.

Other examples of suitable quaternary ammoniums of Formula (I) and (II) are obtained by, e.g., replacing "tallow" in the above compounds with, for example, coco, palm, lauryl, oleyl, ricinoleoyl, stearyl, palmityl, or the like, said fatty acyl chains being either fully saturated, or preferably at least partly unsaturated;

replacing "methyl" in the above compounds with ethyl, ethoxy, propyl, propoxy, isopropyl, butyl, isobutyl or t-butyl;

replacing "chloride" in the above compounds with bromide, methylsulfate, formate, sulfate, nitrate, and the like.

In fact, the anion is merely present as a counterion of the positively charged quaternary ammonium compounds. The nature of the counterion is not critical at all to the practice of the present invention.

By "amine precursors thereof" is meant the secondary or tertiary amines corresponding to the above quaternary ammonium compounds, said amines being substantially protonated in the present compositions due to the claimed pH values.

The quaternary ammonium or amine precursors compounds herein are present at levels of from about 1% to about 80% of compositions herein, depending on the composition execution which can be dilute with a preferred level of active from about 5% to about 15%, or concentrated, with a preferred level of active from about 15% to about 50%, most preferably about 15% to about 35%.

For many of the preceding fabric softening agents, the pH of the compositions herein is an essential parameter of the present invention. Indeed, pH influences the stability of the quaternary ammonium or amine precursors compounds, and of the cellulase, especially in prolonged storage conditions.

The pH, as defined in the present context, is measured in the neat compositions, or in the continuous phase after separation of the dispersed phase by ultra centrifugation, at 20° C. For optimum hydrolytic stability of compositions comprising softeners with ester linkages, the neat pH, measured in the above-mentioned conditions, must be in the range of from about 2.0 to about 4.5, preferably about 2.0 to about 3.5. The pH of such compositions herein can be regulated by the addition of a Bronsted acid. With non-ester softeners, the pH can be higher, typically in the 3.5 to 8.0 range.

Examples of suitable acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids.

Softening agents also useful in the present invention compositions are nonionic fabric softener materials, preferably in combination with cationic softening agents. Typically, such nonionic fabric softener materials have a HLB of from about 2 to about 9, more typically from about 3 to about 7. Such nonionic fabric softener materials tend to be readily dispersed either by themselves, or when combined with other materials such as single-long-chain alkyl cationic surfactant described in detail hereinafter. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g. >40° C.) and relatively water-insoluble.

The level of optional nonionic softener in the compositions herein is typically from about 0.1% to about 10%, preferably from about 1% to about 5%.

Preferred nonionic softeners are fatty acid partial esters of polyhydric alcohols, or anhydrides thereof, wherein the alcohol, or anhydride, contains from 2 to 18, preferably from 2 to 8, carbon atoms, and each fatty acid moiety contains from 12 to 30, preferably from 16 to 20, carbon atoms. Typically, such softeners contain from 1–3, preferably 1–2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from 12 to 30, preferably from 16 to 20, carbon atoms, typical examples of said fatty acids being lauric acid, myristic acid, palmitic acid, stearic acid and behenic acid.

Highly preferred optional nonionic softening agents for use in the present invention are the sorbitan esters, which are esterified dehydration products of sorbitol, and the glycerol esters.

Commercial sorbitan monostearate is a suitable material. Mixtures of sorbitan stearate and sorbitan palmitate having stearate/palmitate weight ratios varying between about 10:1 and about 1:10, and 1,5-sorbitan esters are also useful.

Glycerol and polyglycerol esters, especially glycerol, diglycerol, triglycerol, and polyglycerol mono- and/or di-esters are preferred herein (e.g. polyglycerol monostearate with a trade name of Radiasurf 7248).

Useful glycerol and polyglycerol esters include monoesters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

Dye fixatives

Another essential component of the laundry composition according to the invention are the dye fixatives.

Dye fixing agents, or "fixatives", are well-known, commercially available materials which are designed to improve the wash fastness of fabric dyes by minimizing the loss of dye from fabrics. However the combination of such fixatives with cellulase in the rinse is used in the present invention to improve the overall appearance of fabrics.

Many dye fixatives are cationic, and are based on various quaternized or otherwise cationically charged organic nitrogen compounds. Fixatives are available under various trade names from several suppliers. Representative examples include : CROSCOLOR PMF (July 1981, Code No. 7894) and CROSCOLOR NOFF (January 1988, Code No. 8544) from Crosfield; INDOSOL E-50 (Feb. 27, 1984, Ref. No. 6008.35.84; polyethyleneamine-based) from Sandoz; SANDOFIX TPS, which is also available from Sandoz and is a preferred polycationic fixative for use herein and SANDOFIX SWE (cationic resinous compound). If used, such dye fixatives will be employed with the cellulase in the rinse bath at levels of at least about 0.04 ppm, typically from about 0.04 ppm to about 4000 ppm, depending on the product used (concentrated or diluted) and the levels of rinse as well.

Other cationic dye fixing agents are described in "After-treatments for improving the fastness of dyes on textile fibres" by Christopher C. Cook (REV. PROG. COLORATION Vol. 12, 1982). Dye fixing agents suitable for use in the present invention are ammonium compounds such as fatty acid— diamine condensates e.g. the hydrochloride, acetate, metosulphate and benzyl hydrochloride of oleyldiethyl aminoethylamide, oleylmethyldiethylenediaminemethsulphate, monostearyl-ethylene diaminotrimethylammonium methosulphate and oxidised products of tertiary amines; derivatives of polymeric alkyldiamines, polyamine-cyanuric chloride condensates and aminated glycerol dichlorohydrins.

The amount of dye fixing agent to be employed in the composition of the invention is preferably from 0.01% to 50% by weight of the composition, more preferably from 0.1% to 25% by weight, most preferably from 0.5% to 10% by weight.

If the fabric softener composition is formulated as a pre-soak composition or as a spray composition for pretreatment instead of a rinse added composition, the level of dye fixing agent may go up to 80% by weight of the composition.

Optional ingredients

Fully formulated fabric softening compositions preferably contain, in addition to the fabric softener actives like those presented in formula I or II, one or more of the following ingredients effective for inhibiting the transfer of dyes from one fabric to another during the laundry process.

Especially suitable polymeric dye transfer inhibiting agents are polyamine N-oxide polymers, copolymers of N-vinylpyrrolidone and N-vinylimidazole, polyvinylpyrrolidone polymers, polyvinyloxazolidones and polyvinylimidazoles or mixtures thereof.

a) Polyamine N-oxide polymers

The polyamine N-oxide polymers suitable for use contain units having the following structure formula:

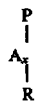

(I)

wherein P is a polymerisable unit, whereto the R—N—O group can be attached to or wherein the R—N—O group forms part of the polymerisable unit or a combination of both.

A is NC(O), $CO_2$, C(O), —O—,—S—, —N—; x is 0 or 1;

R are aliphatic, ethoxylated aliphatics, aromatic, heterocyclic or alicyclic groups or any combination thereof whereto the nitrogen of the N—O group can be attached or wherein the nitrogen of the N—O group is part of these groups.

The N—O group can be represented by the following general structures:

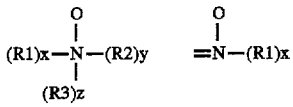

wherein R1, R2, and R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups.

The N—O group can be part of the polymerisable unit (P) or can be attached to the polymeric backbone or a combination of both.

Suitable polyamine N-oxides wherein the N—O group forms part of the polymerisable unit comprise polyamine N-oxides wherein R is selected from aliphatic, aromatic, alicyclic or heterocyclic groups.

One class of said polyamine N-oxides comprises the group of polyamine N-oxides wherein the nitrogen of the N—O group forms part of the R-group. Preferred polyamine N-oxides are those wherein R is a heterocyclic group such as pyrridine, pyrrole, imidazole, pyrrolidine, piperidine, quinoline, acridine and derivatives thereof.

Another class of said polyamine N-oxides comprises the group of polyamine N-oxides wherein the nitrogen of the N—O group is attached to the R-group.

Other suitable polyamine N-oxides are the polyamine oxides whereto the N—O group is attached to the polymerisable unit.

Preferred class of these polyamine N-oxides are the polyamine N-oxides having the general formula (I) wherein R is an aromatic, heterocyclic or alicyclic groups wherein the nitrogen of the N—O functional group is part of said R group.

Examples of these classes are polyamine oxides wherein R is a heterocyclic compound such as pyrridine, pyrrole, imidazole and derivatives thereof.

Another preferred class of polyamine N-oxides are the polyamine oxides having the general formula (I) wherein R are aromatic, heterocyclic or allcyclic groups wherein the nitrogen of the N—O functional group is attached to said R groups.

Examples of these classes are polyamine oxides wherein R groups can be aromatic such as phenyl.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof.

The amine N-oxide polymers of the present invention typically have a ratio of amine to the amine N-oxide of 10:1 to 1:1000000. However the amount of amine oxide groups present in the polyamine oxide polymer can be varied by appropriate copolymerization or by appropriate degree of N-oxidation. Preferably, the ratio of amine to amine N-oxide is from 2:3 to 1:1000000. More preferably from 1:4 to 1:1000000, most preferably from 1:7 to 1:1000000. The polymers of the present invention actually encompass random or block copolymers where one monomer type is an amine N-oxide and the other monomer type is either an amine N-oxide or not. The amine oxide unit of the polyamine N-oxides has a PKa<10, preferably PKa<7, more preferred PKa<6.

The polyamine oxides can be obtained in almost any degree of polymerisation. The degree of polymerisation is not critical provided the material has the desired water-solubility and dye-suspending power.

Typically, the average molecular weight is within the range of 500 to 1000,000; preferably from 1,000 to 50,000, more preferably from 2,000 to 30,000, most preferably from 3,000 to 20,000.

b) Copolymers of N-vinylpyrrolidone and N-vinylimidazole

The N-vinylimidazole N-vinylpyrrolidone polymers used in the present invention have an average molecular weight range from 5,000–1,000,000, preferably from 20,000–200,000.

Highly preferred polymers for use in detergent compositions according to the present invention comprise a polymer selected from N-vinylimidazole N-vinylpyrrolidone copolymers wherein said polymer has an average molecular weight range from 5,000 to 50,000 more preferably from 8,000 to 30,000, most preferably from 10,000 to 20,000.

The average molecular weight range was determined by light scattering as described in Barth H. G. and Mays J. W. Chemical Analysis Vol 113,"Modern Methods of Polymer Characterization".

Highly preferred N-vinylimidazole N-vinylpyrrolidone copolymers have an average molecular weight range from 5,000 to 50,000; more preferably from 8,000 to 30,000; most preferably from 10,000 to 20,000.

The N-vinylimidazole N-vinylpyrrolidone copolymers characterized by having said average molecular weight range provide excellent dye transfer inhibiting properties while not adversely affecting the cleaning performance of detergent compositions formulated therewith.

The N-vinylimidazole N-vinylpyrrolidone copolymer of the present invention has a molar ratio of N-vinylimidazole to N-vinylpyrrolidone from 1 to 0.2, more preferably from 0.8 to 0.3, most preferably from 0.6 to 0.4.

c) Polyvinylpyrrolidone

The compositions of the present invention may also utilize polyvinylpyrrolidone ("PVP") having an average molecular weight of from about 2,500 to about 400,000, preferably from about 5,000 to about 200,000, more preferably from about 5,000 to about 50,000, and most preferably from about 5,000 to about 15,000. Suitable polyvinylpyrrolidones are commercially available from ISP Corporation, New York, N.Y. and Montreal, Canada under the product names PVP K-15 (viscosity molecular weight of 10,000), PVP K-30 (average molecular weight of 40,000), PVP K-60 (average molecular weight of 160,000), and PVP K-90 (average molecular weight of 360,000). Other suitable polyvinylpyrrolidones which are commercially available from BASF Cooperation include Sokalan HP 165 and Sokalan HP 12; polyvinylpyrrolidones known to persons skilled in the detergent field (see for example EP-A-262,897 and EP-A-256,696).

d) Polyvinyloxazolidone

The compositions of the present invention may also utilize polyvinyloxazolidone as a polymeric dye transfer inhibiting agent. Said polyvinyloxazolidones have an average molecular weight of from about 2,500 to about 400,000, preferably from about 5,000 to about 200,000, more preferably from about 5,000 to about 50,000, and most preferably from about 5,000 to about 15,000.

e) Polyvinylimidazole

The compositions of the present invention may also utilize polyvinylimidazole as polymeric dye transfer inhibiting agent. Said polyvinylimidazoles have an average molecular weight of from about 2,500 to about 400,000, preferably from about 5,000 to about 200,000, more preferably from about 5,000 to about 50,000, and most preferably from about 5,000 to about 15,000.

Still other optional ingredients are stabilizers, such as well known antioxidants and reductive agents, soil release polymers, chelants providing color-care, bacteriocides, colorants, perfumes, preservatives, optical brighteners, anti-ionisation agents, antifoam agents and the like.

The invention will now be illustrated in the following non-limiting examples.

EXAMPLES

Example 1

Rinse-added compositions with cellulase and dye fixative

| | % (w/w) | | | |
|---|---|---|---|---|
| | A | B | C | D |
| Fabric Softener Active | 21 | 21 | 21 | 21 |
| Perfume | 0.9 | 0.9 | 0.9 | 0.9 |
| Cellulase (CEVU/gr.) | | | 12 | 12 |
| Sandofix TPS | | 5 | | 5 |
| Water + Minors | Balance | Balance | Balance | Balance |

| Levels | Max Vol | Min Vol |
|---|---|---|
| EU | 25 | 15 |
| US | 80 | 60 |
| JPN | 60 | 20 |
| Dosages | | |
| Dilutes | 110 | |
| Concentrates | 35 | |

ppm Rinse Levels for % levels in product

| Level in Product (% w/w) | Dilutes | | Concentrates | |
|---|---|---|---|---|
| 0.01 | Min | Max | Min | Max |
| EU | 0.44 | 0.73 | 0.14 | 0.23 |
| US | 0.14 | 0.18 | 0.04 | 0.06 |
| JPN | 0.18 | 0.55 | 0.06 | 0.18 |
| Overall Minimum | 0.04 | | | |
| Overall Maximum | 0.73 | | | |

| Level in Product (% w/w) | Dilutes | | Concentrates | |
|---|---|---|---|---|
| 0.1 | Min | Max | Min | Max |
| EU | 4.40 | 7.33 | 1.40 | 2.33 |
| US | 1.38 | 1.83 | 0.44 | 0.58 |
| JPN | 1.83 | 5.50 | 0.58 | 1.75 |
| Overall Minimum | 0.44 | | | |
| Overall Maximum | 7.33 | | | |

| Level in Product (% w/w) | Dilutes | | Concentrates | |
|---|---|---|---|---|
| 0.5 | Min | Max | Min | Max |
| EU | 22.00 | 36.67 | 7.00 | 11.67 |
| US | 6.88 | 9.17 | 2.19 | 2.92 |
| JPN | 9.17 | 27.50 | 2.92 | 8.75 |
| Overall Minimum | 2.19 | | | |
| Overall Maximum | 36.67 | | | |

| Level in Product (% w/w) | Dilutes | | Concentrates | |
|---|---|---|---|---|
| 10 | Min | Max | Min | Max |
| EU | 440.00 | 733.33 | 140.00 | 233.33 |
| US | 137.50 | 183.33 | 43.75 | 58.33 |
| JPN | 183.33 | 550.00 | 58.33 | 175.00 |
| Overall Minimum | 43.75 | | | |
| Overall Maximum | 733.33 | | | |

-continued

| Level in Product (% w/w) | Dilutes | | Concentrates | |
|---|---|---|---|---|
| 25 | Min | Max | Min | Max |
| EU | 1100.00 | 1833.33 | 350.00 | 583.33 |
| US | 343.75 | 458.33 | 109.38 | 145.83 |
| JPN | 458.33 | 1375.00 | 145.83 | 437.50 |
| Overall Minimum | 109.38 | | | |
| Overali Maximum | 1833.33 | | | |

| Level in Product (% w/w) | Dilutes | | Concentrates | |
|---|---|---|---|---|
| 50 | Min | Max | Min | Max |
| EU | 2200.00 | 3666.67 | 700.00 | 1166.67 |
| US | 687.50 | 916.67 | 218.75 | 291.67 |
| JPN | 916.67 | 2750.00 | 291.67 | 875.00 |
| Overall Minimum | 218.75 | | | |
| Overall Maximum | 3666.67 | | | |

Heavy bleeding blue cotton socks are washed in a 10 cycle test with the compositions A, B, C and D.

The softener active used is N,N-di(2-tallowoyl-oxy-ethyl)-N,N-dimethylammoniumchloride and cellulase used is the preparation consisting essentially of a homogeneous endoglucanase component, which is immunoreactive with an antibody raised against a highly purified 43 kD cellulase derived from Humicola insolens DSM 1800.

Color values are measured with a Spectraflash (Data color Int.). Dye contents and delta E values are given versus new untreated socks.

| | | | | | Differences[a] | | |
|---|---|---|---|---|---|---|---|
| | A | B | C | D | B↔A | C↔A | D↔A |
| k/s average (%) | 53 | 61 | 58 | 67 | +8 | +5 | +14 |
| delta E average | 9.07 | 6.64 | 7.76 | 5.29 | +2.43 | +1.31 | +3.78 |

[a]Difference is calculated vs. the no softener leg. The more positive the difference, the better the color maintenance.

These results show that the combination of Sandofix TPS and the cellulase used improves color care by delivering benefits for both depilling and improved color maintenance under realistic washing conditions.

We claim:

1. Laundry compositions comprising a cellulase enzyme, wherein said cellulase enzyme consists essentially of a homogeneous endoglucanase component which is immunoreactive with an antibody raised against a highly purified 43 kD cellulase derived from Humicola insolens, DSM 1800, or which is homologous to said 43 kD endoglucanase, and a cationic dye fixing agent selected from the group consisting of the hydrochloride, acetate, methosulphate and benzyl hydrochloride salts of oleyldiethylaminoethylamide, oleylmethyl-diethylenediaminemethsulphate and monostearyl-ethylene diaminotrimethylammonium methosulphate; characterized in that the enzyme is present at a level of ranging from 0.05 CEVU/gram to 125 CEVU/gram finished product and that the dye fixing agent is present at levels comprised between 0.01% and 50% by weight.

2. Laundry composition according to claim 1 wherein the composition is a detergent composition.

3. Laundry composition according to claim 1 wherein the composition is a fabric softener composition.

4. Fabric softener composition according to claim 3 wherein the composition contains a quaternary ammonium softening agent, amine precursor softening agent, or mixtures thereof.

5. Fabric softener composition according to claim 4 wherein the quaternary ammonium softening agent is N,N-di(2-tallowoyl-oxy-ethyl)-N,N-dimethyl ammonium chloride.

6. Fabric softener composition according to claim 5 wherein the tallow chains in said quaternary ammonium softening agent are derived from fatty acids having an Iodine Value (IV) of from 5 to 25 and a cis-trans ratio isomer weight of greater that about 30/70.

7. Fabric softener composition according to claim 3 wherein the tallow chains in said quaternary ammonium softening agent are derived from fatty acids having an Iodine Value (IV) above 25.

8. Method for improving the color depth maintenance of laundered fabrics comprising the steps of contacting the fabric with a composition according to claim 3.

* * * * *